US006301717B1

(12) United States Patent
Matsumoto et al.

(10) Patent No.: US 6,301,717 B1
(45) Date of Patent: Oct. 16, 2001

(54) CLOTHES

(75) Inventors: Shingo Matsumoto, Shiga; Yoshikazu Tsuji, Aichi, both of (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/417,185

(22) Filed: Oct. 12, 1999

(51) Int. Cl.[7] ..... A41D 27/00; A41D 27/10

(52) U.S. Cl. ..... 2/243.1; 2/69; 2/125

(58) Field of Search ..... 2/243.1, 69, 79, 2/82, 85, 93, 106, 108, 113, 115, 118, 125, 227; 28/151, 153, 154; 66/171, 175, 176, 177, 178 R, 189; 139/DIG. 1

(56) References Cited

U.S. PATENT DOCUMENTS 3,635,051 * 1/1972 Betts et al. ..... 66/128
3,673,821 * 7/1972 Johnson ..... 2/224 R
3,702,068 * 11/1972 Betts et al. ..... 66/176
3,703,820 * 11/1972 Jackson ..... 66/177
3,882,697 * 5/1975 Betts et al. ..... 66/176
4,111,009 * 9/1978 Robinson et al. ..... 2/90
4,122,555 * 10/1978 Safrit et al. ..... 2/401
4,704,976 * 11/1987 London et al. ..... 2/243
4,783,858 * 11/1988 Chevalier ..... 2/90
5,631,074 * 5/1997 Herlihy, Jr. ..... 2/2.15

FOREIGN PATENT DOCUMENTS 6-81202 3/1994 (JP) .
7-109601 4/1995 (JP) .

* cited by examiner

*Primary Examiner*—Amy B. Vanatta
(74) *Attorney, Agent, or Firm*—Schnader Harrison Segal & Lewis LLP

(57) ABSTRACT

This invention provides clothes, wherein a fabric wale of one of parts (a) and (b) destined to be rubbed against each other is arranged so that it satisfies at least one of the following alternatives (i) and (ii):

(i) it crosses with the fabric wale of another part at an angle of 35 to 145 degrees when the respective parts are placed so that their axial lines are kept parallel.

(ii) it crosses with its axial line at an angle of 55 to 125 degrees.

This invention provides clothes which can manifest the basic functions of the fabric such as water repellence, water pressure resistance, and good look & taste, can respond to the diversification of needs without impairing the basic functions of clothes and can reduce the rubbing noise and friction noise of clothes.

13 Claims, 8 Drawing Sheets

4E
9
2E
4D
θB
2D
1a
θC
2C
θD
5
4C
8
9
θE
2B
2A
3
4B
9
4A
6

CLOTHES

BACKGROUND OF THE INVENTION

1. Filed of the Invention

The present invention relates to clothes capable of reducing the rubbing noise and friction noise of the clothes. In more detail, the present invention relates to clothes which can reduce the rubbing noise and friction noise of tops and bottoms of Windbreakers, sweat wear, winter clothes, raincoats, working clothes, etc., more particularly the arm rubbing noise and thigh rubbing noise during running, arm rubbing noise during swinging in outdoor sports such as golfing and fishing, rubbing noise of Windbreakers, sweat wear, winter clothes, raincoats, etc., the rubbing noise during working actions, etc.

2. Description of the Related Art

Various ideas are proposed for reducing the rubbing noise and friction noise of clothes.

For example, Japanese Utility-Model Laid-Open (Kokai) No. Hei7-9920 and Japanese Patent Laid-Open (Kokai) No. Hei7-9921 disclose waterproof clothes which use a highly water pressure resistant material at the shoulder and arm portions and use a less water pressure resistant, soft and less noisy high density woven or knitted fabric attached in any different fabric wale direction at the belly portion less subject to rain, for reducing the rubbing noise generated when the materials are rubbed against each other.

Furthermore, Japanese Patent Laid-Open (Kokai) No. Hei5-331771 discloses a moisture permeable waterproof fabric using polyamide multifilaments reduced in rubbing noise by enhancing the breaking strength.

However, the tops described in said Japanese Utility-Model Laid-Open (Kokai) No. Hei7-9920 and Japanese Patent Laid-Open (Kokai) No. Hei7-9921 sacrifice the water resistance most important as a raincoat, and impose many restrictions in design. Furthermore, the high density woven or knitted fabric must have a very high density to achieve water resistance to some extent, making the clothes hard in look and taste, and a large effect cannot be expected to be achieved in reducing the friction noise and rubbing noise. Moreover, the noise caused by the deflection of the fabric is also large. So, the proposed clothes cannot be satisfactory.

The fabric described in Japanese Patent Laid-Open (Kokai) No. Hei5-331771 allows only slight commercial variations, and it is difficult to respond to the recent diversification of needs.

The object of the present invention is to provide clothes which can manifest the basic functions of the fabric such as water repellence, water pressure resistance and good look and taste to the maximum extent, can respond to the diversification of needs without impairing the basic functions of clothes, and can reduce the rubbing noise and friction noise of clothes. The inventors studied intensively the means for reducing the friction noise and rubbing noise of clothes, and as a result, paid attention to the pattern drawing angle or pattern layout angle which is traditionally set at 0 degree by letting the axial line (center line) of clothes agree in direction with the fabric wales. Thus, the present invention has been achieved.

SUMMARY OF THE INVENTION

The clothes of the present invention adopt the following features for solving the above mentioned problems.

Clothes, wherein a fabric wale of one of parts (a) and (b) destined to be rubbed against each other is arranged so that it satisfies at least one of the following alternatives (i) and (ii):

(i) it crosses with the fabric wale of another part at an angle of 35 to 145 degrees when the respective parts are placed so that their axial lines are kept parallel.

(ii) it crosses with its axial line at an angle of 55 to 125 degrees.

Preferably, the parts (a) and (b) destined to be rubbed are body and sleeve, or inner thigh portions of pants respectively.

MEANINGS OF SYMBOLS

Figure 1:
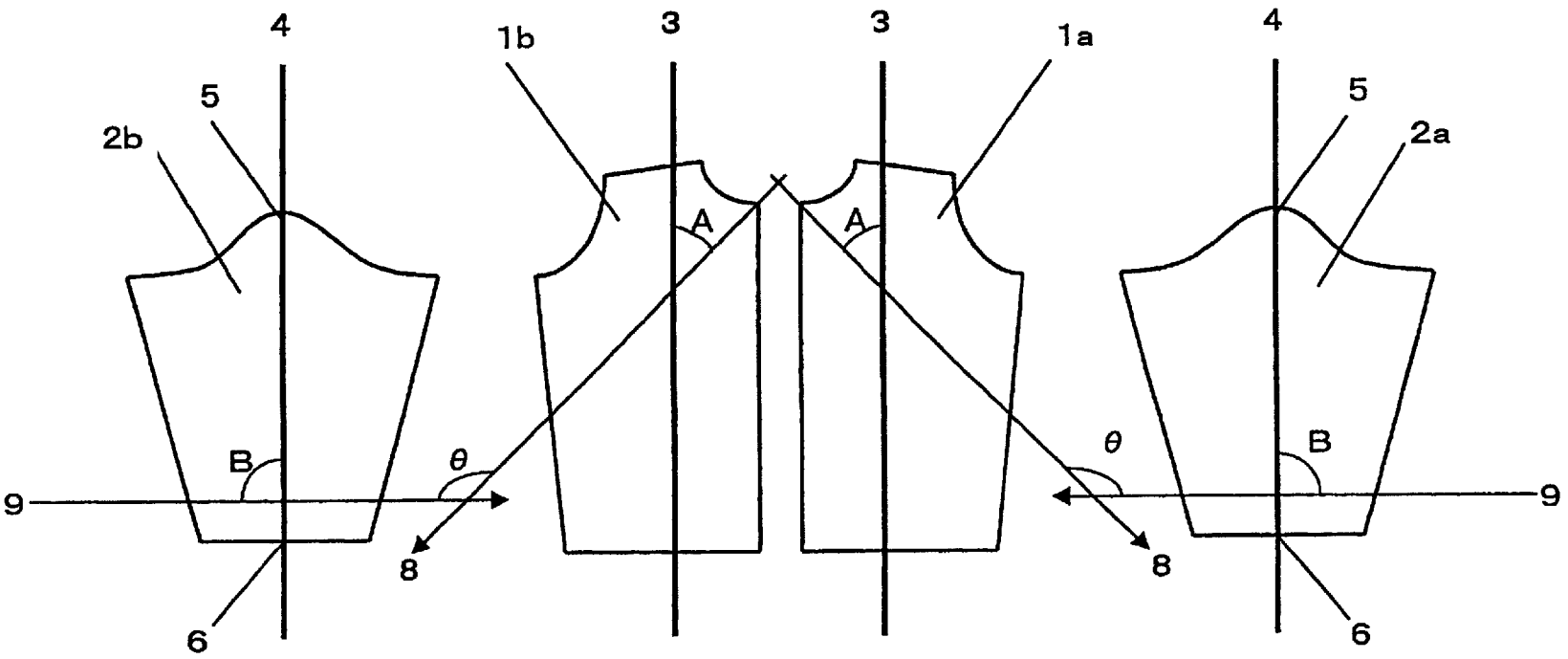
FIG. 1 is a plan view showing cut and developed bodies 1*a* and 1*b* and sleeves 2*a* and 2*b* as an example of the present invention.

1*a*: left front body
1*b*: right front body
2*a*: left sleeve
2*b*: right sleeve
3: axial line of body
4: sleeve cap line
5: sleep cap point
6: central portion of cuff
7: crossing angle between fabric wales
8: fabric wales of body
9: fabric wales of sleeve
10: rubbing course
A: angle formed between the axial line and the fabric wales of a body B: angle formed between a sleeve cap line and fabric wales
θ: crossing angle
a: part
b: part

DETAILED DESCRIPTION OF THE INVENTION

The clothes of the present invention are described below in detail in reference to examples shown in the drawings.

FIG. 1 is a plan view showing cut and developed bodies 1*a* and 1*b* and sleeves 2*a* and 2*b* as an example of the present invention. The axial lines 3 of the bodies in the present invention are usually parallel to the center line of clothes, and in the case of clothes with a placket front or fastener attached, they are parallel to the placket front line or fastener attaching line.

A sleeve cap line 4 is a straight line connecting a sleeve cap point 5 with the centeral portion 6 of a cuff, and when the clothes are folded on a plane, it agrees with the line connecting the shoulder with the cuff top.

The sleeve cap point 5 is the portion sewn to the shoulder of a front, being the highest portion of the sleeve cap.

The fabric wale of the fabric used to make respective parts in the present invention is a ridge or raised line of thread in the axial direction on woven or knitted fabric. In the woven fabric, the warp threads or weft threads in the more raised direction are fabric wales.

Figure 2:
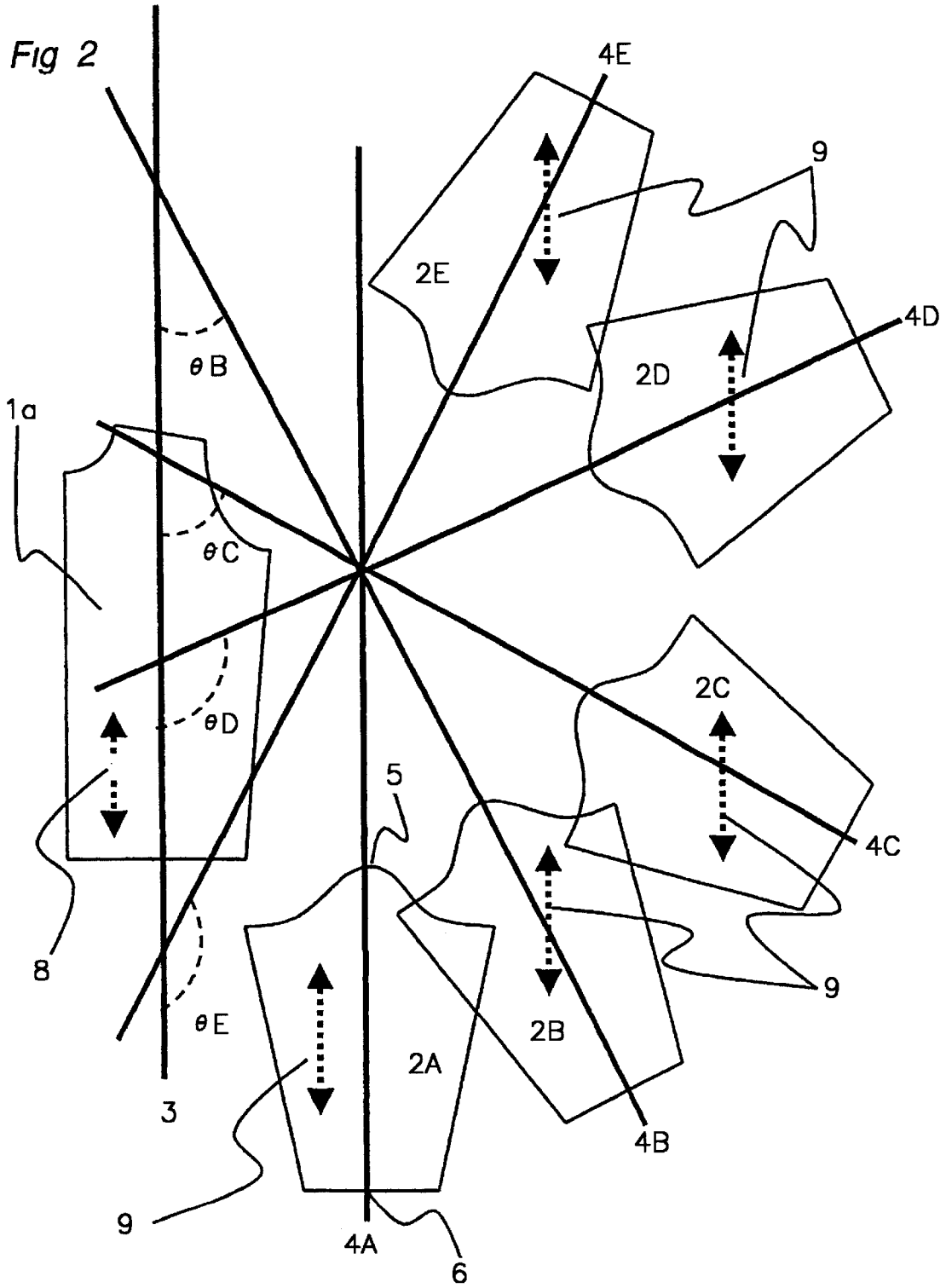
FIG. 2 is a plan view showing the relation among the axial line of a body, sleeve cap lines and fabric wales.
Figure 3:
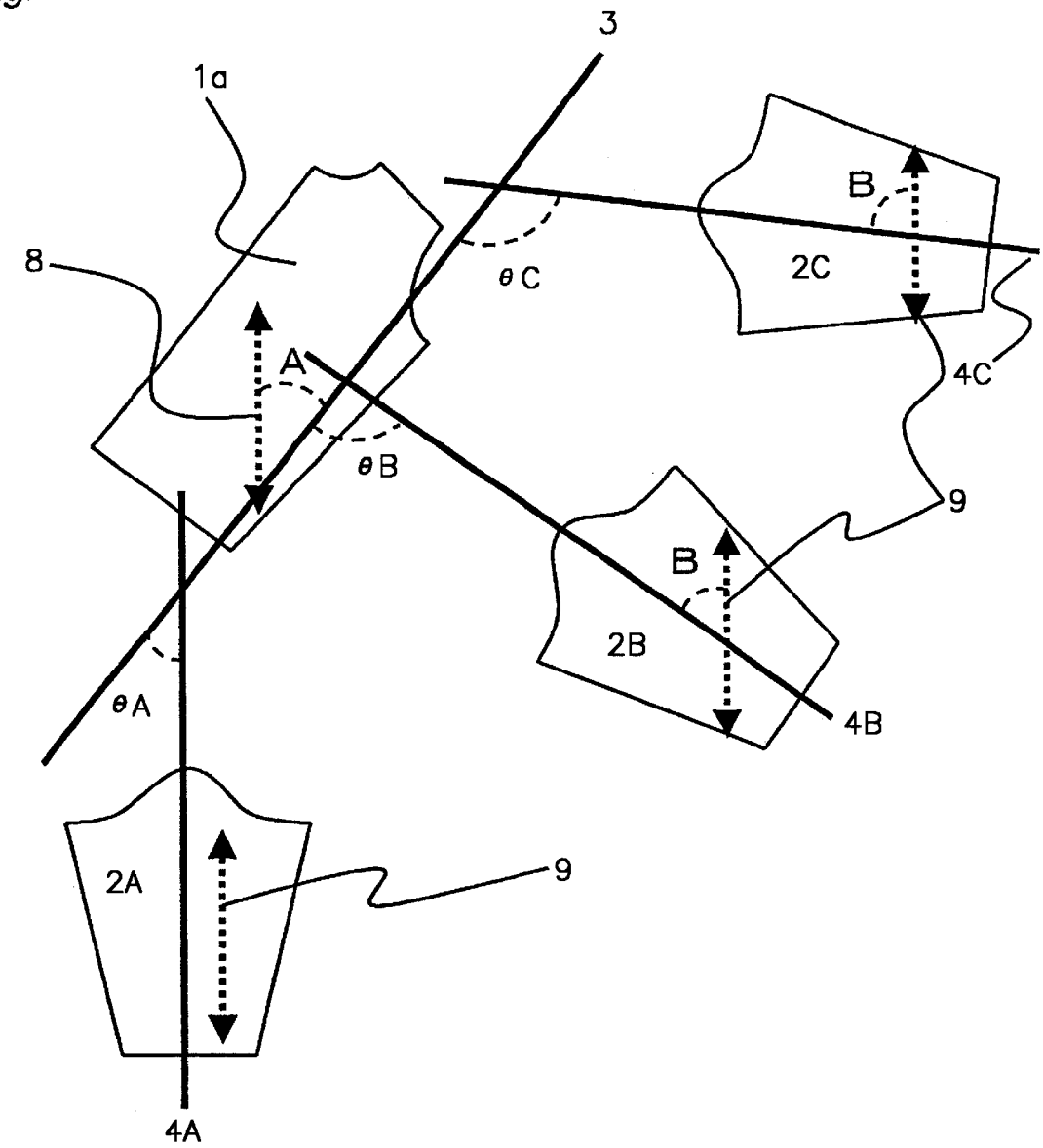
FIG. 3 is a plan view showing the relation among the axial line of a body, sleeve cap lines and fabric wales, as an example of the present invention.

The crossing angle (θ) in the present invention refers to the angle at which the extensions of the fabric wales of a body and the extensions of the fabric wales of the sleeve attached to the body cross each other when the axial line 3 of the body is kept in parallel to the sleeve cap line 4, as shown in FIG. 1. In other words, in FIG. 2 showing ordinary clothes and examples of the present invention, when the fabric wales of a body la are kept in parallel to the fabric wales of respective sleeves 2A, 2B, 2C, 2D and 2E, the crossing angle (θ) refers to the angle θA(not illustrated), θB, θC, θD or θE of the point at which the axial line 3 of the body or its extension crosses the extension of the axial line 4A, 4B, 4C, 4D or 4E of any of the sleeves, and it is preferable that the respective axial lines cross each other at an angle θ of 35 to 145 degrees, more preferably 60 to 120 degrees, still more preferably 70 to 110 degrees. FIG. 3 shows further other examples of the present invention.

In the example shown in FIG. 3, when the fabric wales of a body 1*a* are kept in parallel to the fabric wales of sleeves 2A, 2B and 2C, an angle (A) is formed between the fabric wales 8 and the axial line 3 of of the body 1*a*. The crossing angle (θ) refers to the angle θA, θB or θC of the point at which the axial line 3 of the body or its extension crosses the extension of the axial line 4A, 4B or 4C of any of the sleeves as in FIG. 2, and it is preferable that the crossing angle θ is 35 to 145 degrees.

The angle (θ) is equal to the angle obtained by adding the angle (A) formed between the axial line 3 and the fabric wales 8 of the body and the angle (B) formed between the sleeve cap line 4 and the fabric wales 9 of the sleeve.

Figure 4:
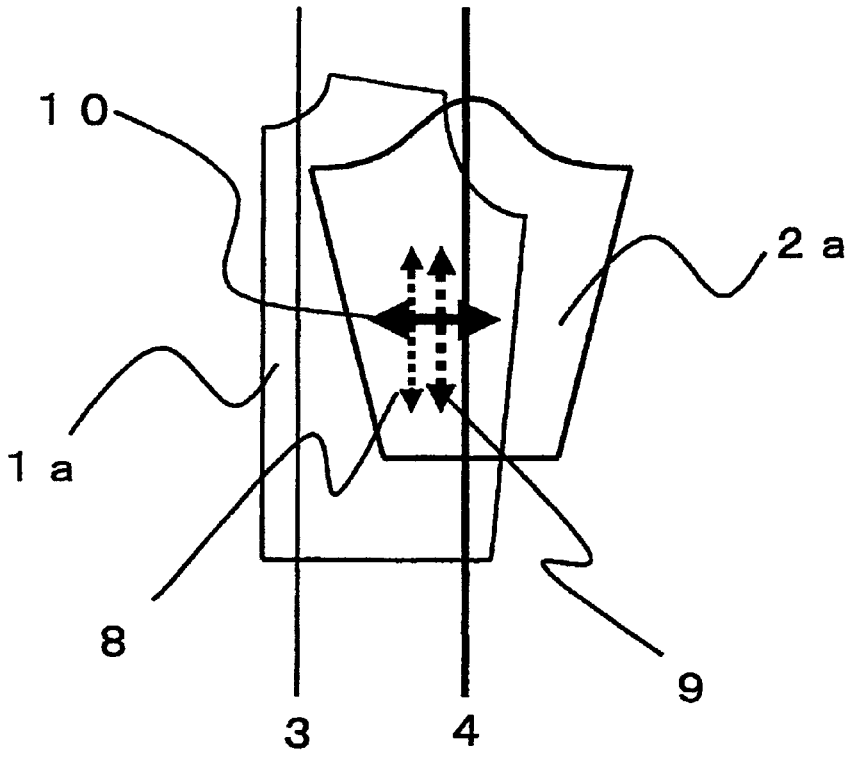
FIG. 4 is a plan view showing parts of a conventional product at the portions destined to be rubbed against each other.

In FIG. 4, a body 1*a* and a sleeve 2*a* are used as parts (a) and (b) of conventional clothes, and they are developed on a plane, to overlie on each other at their mutually rubbing course 10.

Figure 5:
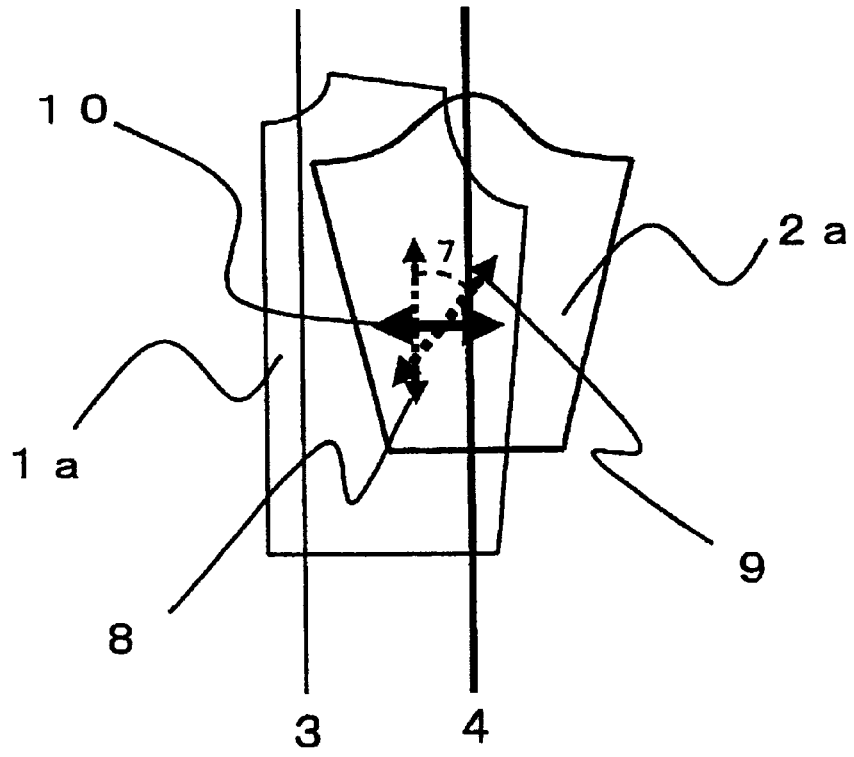
FIG. 5 is a plan view showing parts of the present invention at the portions destined to be rubbed against each other.

In FIG. 5, a body 1*a* and a sleeve 2*b* are used as parts (a) and (b) as an example of the present invention, and they are developed on a plane, to overlie on each other at their mutually rubbing course 10.

The rubbing course 10 of the present invention corresponds to the portions destined to be rubbed against each other, of clothes when the clothes are worn by a human body, and expresses the range in which the fabric portions destined to be rubbed against each other contact each other. The rubbing course occurs at portions where arms, legs, etc. are moved, such as underarm portions, chest-to-belly portions, and inner thigh portions.

In the present invention, when the parts (a) and (b) are placed on a plane, to overlie on each other at their mutually rubbing course 10, it is preferable that the crossing angle 7 between the fabric wales 8 of the part (a) and the fabric wales 9 of the part (b) is 35 to 145 degrees. If the angle is less than 35 degrees or more than 145 degrees, the projections and depressions of the fabric wales and the single fibers of the fiber bundles of respective parts are entangled with each other to decrease the effect of reducing the rubbing noise and friction noise.

In the present invention, it is more effective that the rubbing course 10 of mutually rubbed portions of clothes agrees in direction with the fabric wales of at least one of the parts containing the portions destined to be rubbed against each other, of the clothes.

Figure 10:
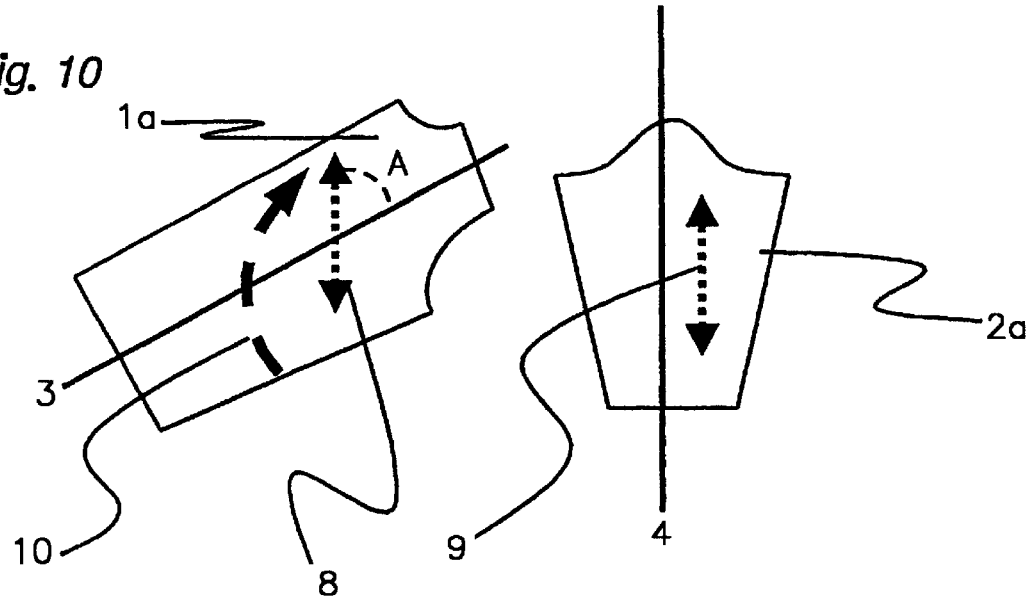
FIG. 10 shows drawn patterns of an example where the rubbing direction of the mutually rubbed portions agrees with fabric wales.

FIG. 10 shows an example of the present invention in which the rubbing course 10 of mutually rubbed portions agrees in direction with the fabric wales 8 of a part.

The mutually rubbed portions of parts of clothes worn by a human body are different from motion to motion, but what is common in all motions is that the rubbing course of the mutually rubbed portions shows a circular arc locus and partly includes a course substantially perpendicular to the axial direction of at least one of the parts of the clothes. So, if the direction at the central portion of the rubbing course agrees with the fabric wales of a part, the projections and depressions of fibers constituting fiber bundles of the part are not engaged with those of the other mating part, to provide a higher effect of reducing the rubbing noise. The angle between the fabric wales of one of the rubbing parts and its axial line should be 55 to 125 degrees, preferably 65 to 115 degrees, more preferably 75 to 105 degrees.

For fabricating the clothes of the present invention, it is only required to set the angle at the time of drawing patterns for cutting parts of the clothes, and after cutting, the parts are required to be simply sewn together as practiced with conventional clothes.

Figure 6:
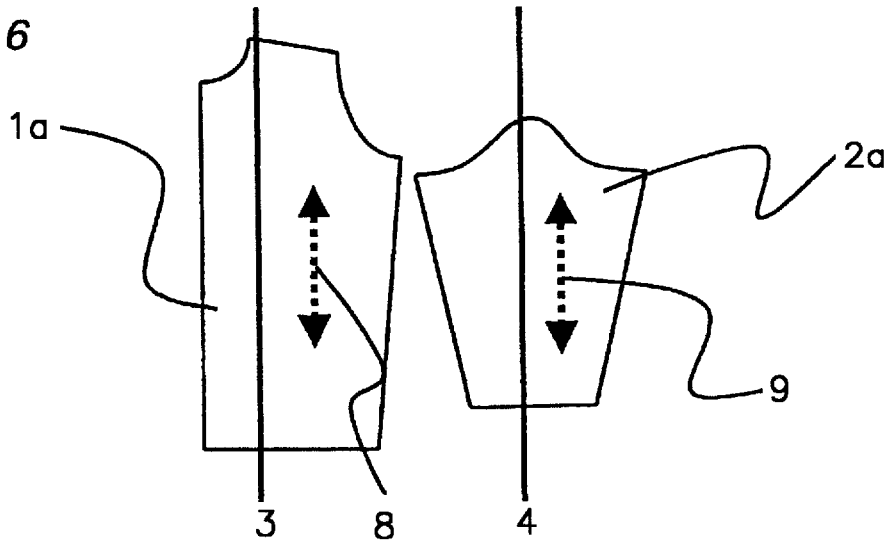
FIG. 6 shows drawn patterns of conventional clothes.

FIG. 6 shows a pattern drawing example for conventional clothes, in which the axial line 3 of a body and a sleeve cap line 4 agree in direction with the respective fabric wales 8 and 9.

FIGS. 7, 8, 9 and 10 show pattern drawing examples of the present invention.

Figure 7:
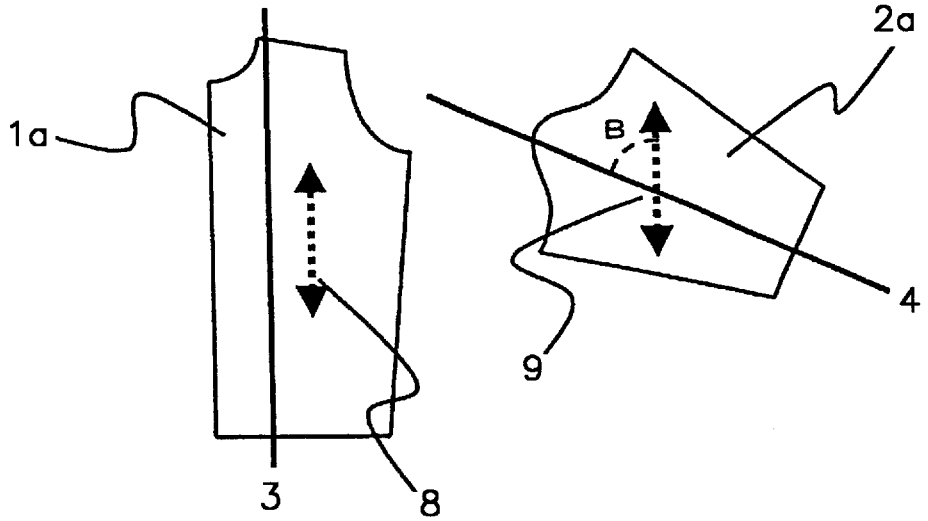
FIG. 7 shows drawn patterns of an example of the present invention.

In the example shown in FIG. 7, the angle (A) between the axial line 3 and the fabric wales 8 of a body is set at 0°, and the angle (B) between a sleeve cap line 4 and fabric wales 9 is set at 65° C., to let the fabric wales of the body agree in direction with the rubbing course of the mutually rubbed portions, and to keep the angle between the axial line and the sleeve cap line at 65°.

Figure 8:
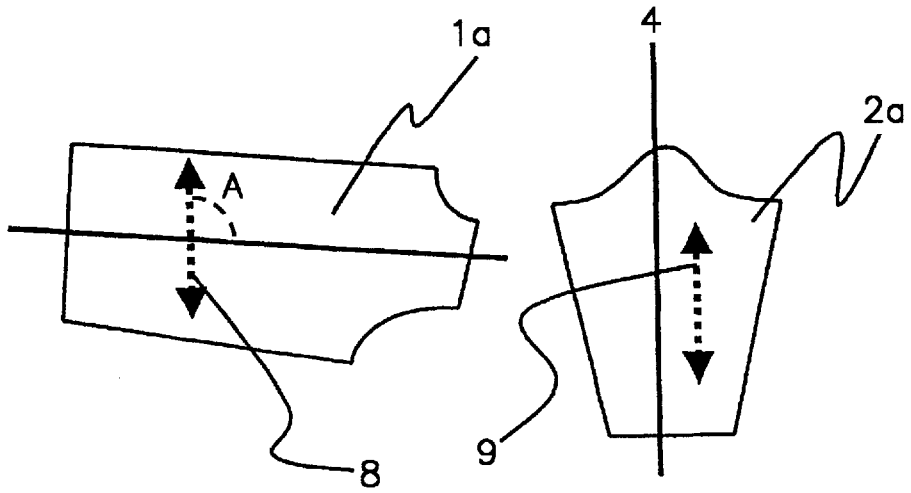
FIG. 8 shows drawn patterns of an example of the present invention.

In the example shown in FIG. 8, the angle (A) between the axial line 3 and the fabric wales 8 of a body is set at 95°, and the angle (B) between a sleeve cap line 4 and fabric wales 9 is set at 0°, to keep the angle between the axial line and the sleeve cap line at 95°.

Figure 9:
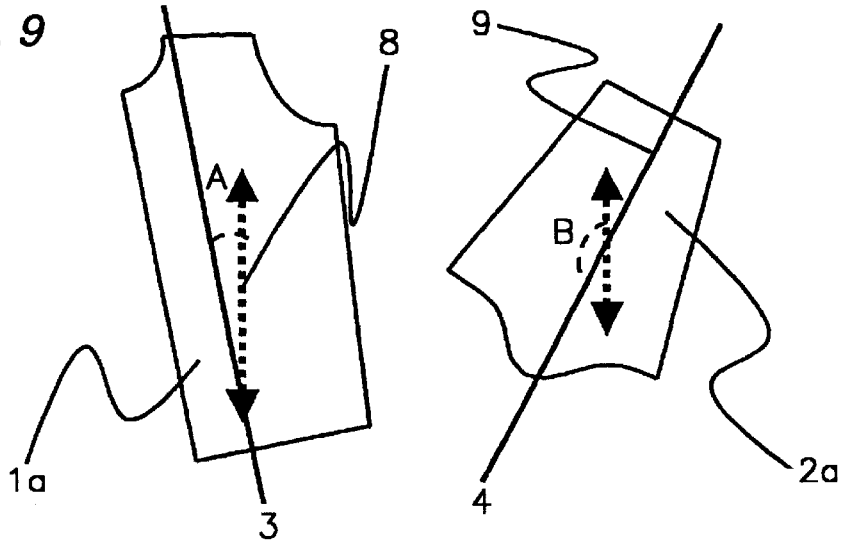
FIG. 9 is drawn patterns of an example of the present invention.

In the example shown in FIG. 9, the angle (A) between the axial line 3 and the fabric wales 8 of a body is set at −10°, and the angle (B) between a sleeve cap line 4 and fabric wales 9 is set at 155° C., to keep the angle between the axial line and the sleeve cap line at 145°.

In the example shown in FIG. 10, the angle (A) between the axial line 3 and the fabric wales 8 of a body is set at 65°, to let the fabric wales 8 of the body agree with the direction at the central portion of the rubbing course 10 of the mutually rubbed portions, and the angle (B) between a sleeve cap line 4 and fabric wales 9 is set at 0°, to keep the angle between the axial line and the sleeve cap line at 65°.

Figure 11:
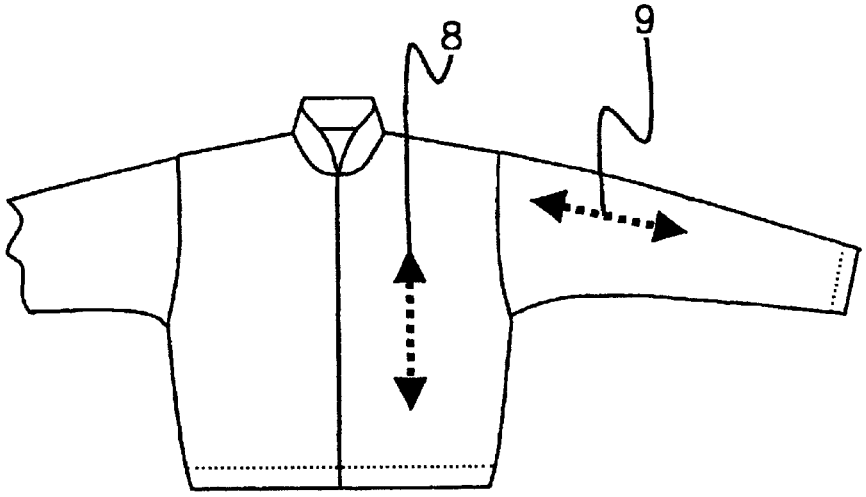
FIG. 11 is an illustration showing the fabric wales of a body and a sleeve of clothes fabricated based on the drawn patterns for conventional clothes.
Figure 12:
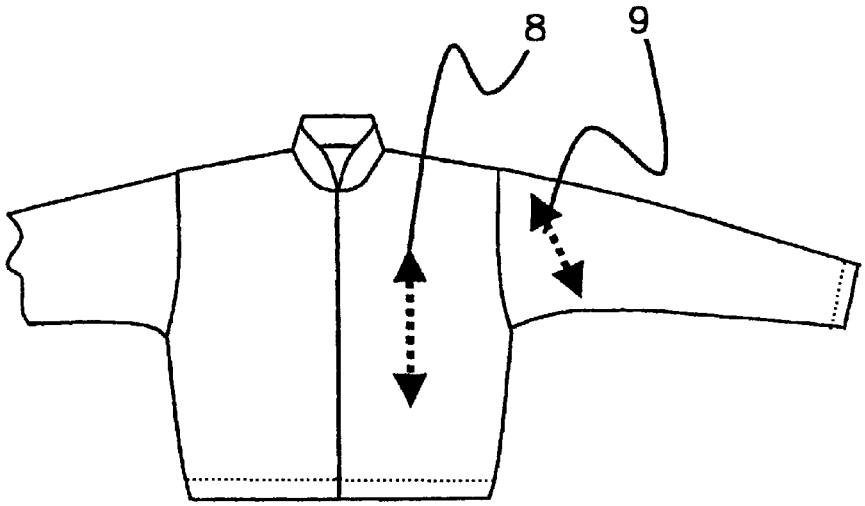
FIG. 12 is a plan view showing clothes as an example of the present invention.
Figure 13:
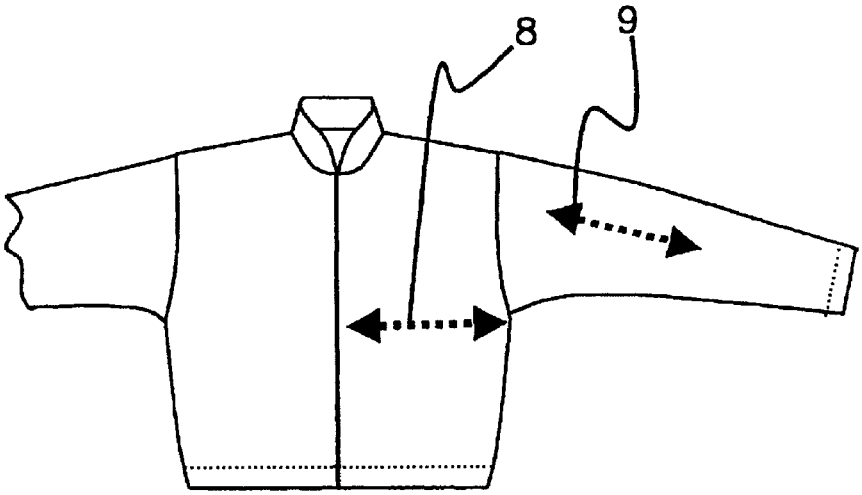
FIG. 13 is a plan view showing clothes as an example of the present invention.
Figure 14:
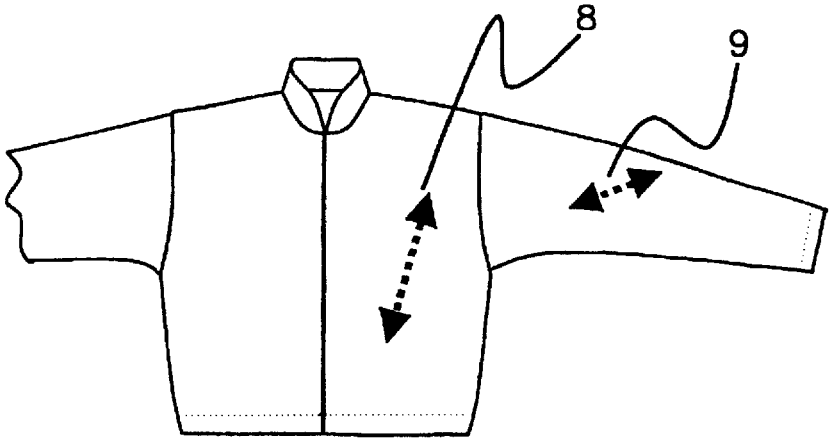
FIG. 14 is a plan view showing clothes as an example of the present invention.
Figure 15:
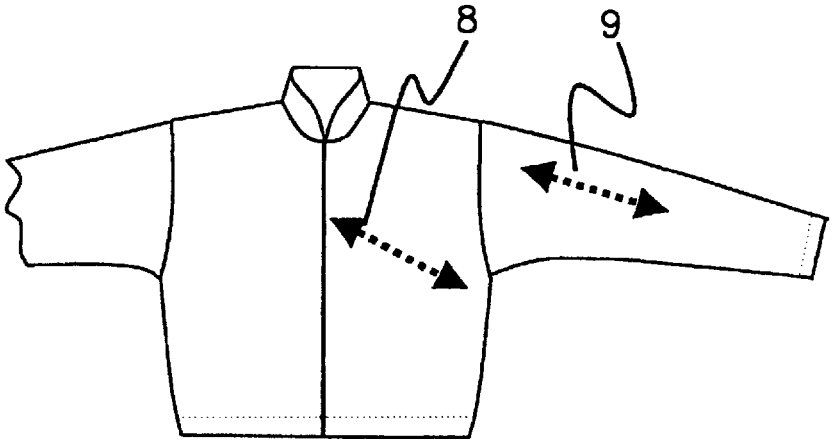
FIG. 15 is a plan view showing clothes as an example of the present invention.

FIG. 11 shows the fabric wales of the bodies and the sleeves of the clothes fabricated by cutting and sewing based on the pattern drawing example of conventional clothes shown in FIG. 6.

FIGS. 12, 13, 14 and 15 show the fabric wales of the bodies and sleeves of the clothes fabricated by cutting and sewing based on the pattern drawing examples of the present invention shown in FIGS. 7, 8, 9 and 10.

It is preferable that the parts containing the portions destined to be rubbed against each other, of the clothes of the present invention are made from a woven or knitted fabric with wales or ridges. It is more preferable that a fabric other than 1/1 in the number of floats of warp and weft, i.e., a fabric other than a plain weave fabric is used at least partially or entirely as the parts containing the portions destined to be rubbed against each other.

For example, it is preferable to use a twill weave fabric or satin weave fabric of 2/1, 3/1, 1/2 or 1/3, etc., and it is effective to use the fabric as all of the bodies and sleeves. However, it is also possible, for example, to use a twill weave fabric as the bodies and a plain weave fabric as the sleeves, or to use a twill weave fabric or satin weave fabric only at the portions destined to be rubbed against each other, of the front sleeve portions and underarm portions of bodies, by attaching them in any different fabric wale direction.

Figure 16:
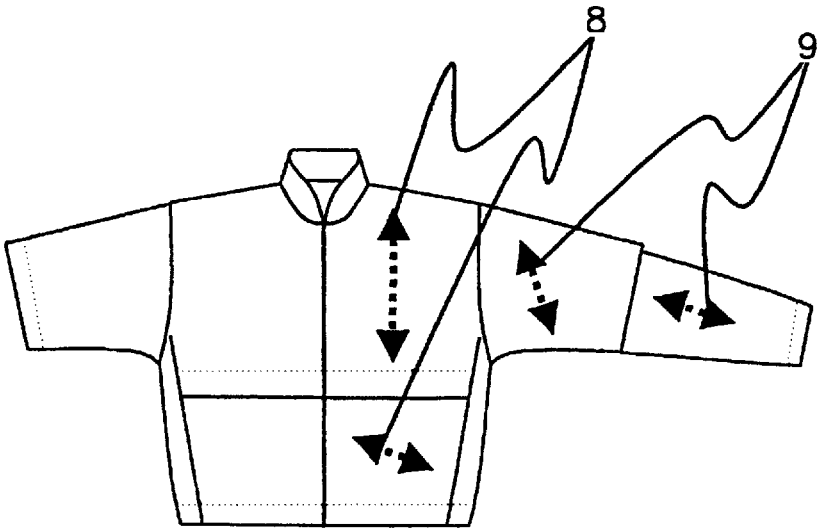
FIG. 16 is a plan view showing clothes as an example of the present invention where an air ventilation and a part different in wale direction are attached.

It is also possible to adopt air ventilations, etc. FIG. 16 shows an example of the present invention adopting an air ventilation and a portion attached in a different fabric wale direction.

In the present invention, linings can be used without any problem. If a coated material or laminated material is used for water resistance in a raincoat, etc., it is more preferable and effective to use a raised mesh material obtained by raising an ordinary mesh material, for example, a fabric knitted like a net, on one side by buffing, etc., as a lining in such a manner that the raised mesh material is sewn to the face fabric with the raised face turned toward the face fabric.

EXAMPLES

Clothes of the present invention are described below in reference to examples and comparative examples.

Example 1

An urethane coated 2/1 twill weave fabric having 146 70-denier nylon filament warp threads per inch and 94 identical weft threads per inch was used to fabricate clothes by cutting and sewing bodies and sleeves with the angle (A) between the axial lines 3 of the front bodies and the fabric wales 8 of the bodies set at 0 degree and with the angle (B) between the sleeve cap lines 4 and the fabric wales 9 of the sleeves set at 90 degrees for keeping the crossing angle (θ) at 90 degrees. A person wearing the clothes swung his arms at a rate of one reciprocation per second in a sound-proof room with a background noise of 15 dB at 3150 Hz, and the noise generated by rubbing of the clothes was picked up by a microphone, Type 1115 produced by JEIC Denshi Sokki K.K. and installed at 20 cm away from him, and measured by a precision noise meter, Type 1030 produced by JEIC Denshi Sokki K.K.

Furthermore, the friction coefficient between the fabric parts rubbed against each other at this angle, at a load of 100 g, with a contact area of 35 $cm^2$ and at a tensile speed of 10 cm/min was measured as resistance by a U gauge and recorded by a strain indicating recorder (Shinko Type RC9001). The results are shown in Table 1.

Example 2

Clothes were fabricated as described for Example 1, except that the bodies and sleeves were cut and sewn with the angle (A) between the axial lines 3 of the front bodies and the fabric wales 8 of the bodies set at 0° and with the angle (B) between the sleeve cap lines 4 and the fabric wales 9 of the sleeves set at 95° for keeping the crossing angle (θ) at 95°, and that mesh linings were attached with the raised faces kept in contact with the coated side of the fabric. The rubbing noise and friction coefficient were evaluated as described for Example 1, and the results are shown in Table 1.

Example 3

Clothes were fabricated as described for Example 1, except that the bodies and sleeves were cut and sewn with the angle (A) between the axial lines of the front bodies and the fabric wales 8 of the bodies set at 45 degrees and with the angle (B) between the sleeve cap lines 4 and the fabric wales 9 of the sleeves set at 90 degrees, to keep the crossing angle (θ) at 135 degrees. The rubbing noise and friction coefficient were evaluated as described for Example 1, and the results are shown in Table 1.

Example 4

Clothes were fabricated as described for Example 1, except that the bodies and sleeves were cut and sewn with the angle (A) between the axial lines 3 of the front bodies and the fabric wales 8 of the bodies set at 75 degrees and the angle (B) between the sleeve cap lines 4 and the fabric wales 9 of the sleeves set at −30 degrees, to keep the crossing angle (θ) at 45 degrees. The rubbing noise and friction coefficient were evaluated as described for Example 1, and the results are shown in Table 1.

Example 5

Clothes were fabricated as described for Example 1, except that the bodies and sleeves were cut and sewn with the angle (A) between the axial lines 3 of the front bodies and the fabric wales 8 of the bodies set at −15° and the angle (B) between the sleeve cap lines 4 and the fabric wales 9 of the sleeves set at 135°, to keep the crossing angle (θ) at 120°. The rubbing noise and friction coefficient were evaluated as described for Example 1, and the results are shown in Table 1.

Example 6

Clothes were fabricated as described for Example 1, except that the bodies and sleeves were cut and sewn with the angle (A) between the axial lines of the front bodies and the fabric wales 8 of the bodies set at 65° and the angle (B) between the sleeve cap lines 4 and the fabric wales 9 of the sleeves set at 0° C., to keep the crossing angle (θ) at 65°. The rubbing noise and friction coefficient were evaluated as described for Example 1, and the results are shown in Table 1.

Example 7

Clothes were fabricated as described for Example 1, except that the bodies and sleeves were cut and sewn with the angle (A) between the axial lines 3 of the front bodies and the fabric wales 8 of the bodies set at 0° and the angle (B) between the sleeve cap lines 4 and the fabric wales 9 of the sleeves set at 95°, to keep the crossing angle (θ) at 95°, and the mesh linings not raised were attached. The rubbing sound and friction coefficient were evaluated as described for Example 1, and the results are shown in Table 1.

Example 8

Clothes were fabricated as described for Example 1, except that an urethane coated 1/1 plain weave fabric having 126 70-denier nylon filament warp threads per inch and 88 identical weft threads per inch was used for the front bodies, with the angle (A) between the axial lines 3 of the bodies and the fabric wales 8 of the bodies set at 45°, and that the 2/1 twill weave fabric shown in Example 1 was used for the sleeves, with the angle (B) between the sleeve cap lines 4 and the fabric wales 9 of the sleeves set at 90°, to keep the crossing angle (θ) at 135° C. The rubbing noise and friction coefficient were evaluated as described for Example 1, and the results are shown in Table 1.

Example 9

Clothes were fabricated as described for Example 2, except that air ventilations were attached to the chest portion and the back portion. The rubbing noise and friction coefficient were evaluated as described for Example 2, and the results are shown in Table 1.

Example 10

An urethane coated 2/1 twill weave fabric having 146 70-denier nylon filament warp threads per inch and 94 identical weft threads per inch was used to fabricate waterproof pants by cutting and sewing parts with the angle between the axial lines and the fabric wales of the right front body and the right back body set at 0° and the angle between the axial lines and the fabric wales of the left front body and the left back body set at 95° C., to keep the crossing angle between the axial lines at 95° and to keep the crossing angle between the fabric wales at the rubbing course portions at 95°. A person wearing the pants stepped at a rate of one reciprocation per second, and the rubbing noise of the clothes was measured.

Furthermore, the friction coefficient between the fabric parts rubbed against each other at this angle, at a load of 100 g, with a contact area of 35 $cm^2$ and at a tensile speed of 10 cm/min was measured as resistance by a U gauge and recorded by a strain indicating recorder (Shinko Type RC9001). The results are shown in Table 1.

Comparable Example 1

Clothes were fabricated as described for Example 1, except that the bodies and sleeves were cut and sewn with the angle (A) between the axial lines 3 of the front bodies and the fabric wales of the bodies set at 0 degree and with the angle (B) between the sleeve cap lines 4 and the fabric wales 9 of the sleeves set at 0 degree, to keep the crossing angle (θ) at 0 degree. The rubbing noise and friction coefficient were evaluated as described for Example 1, and the results are shown in Table 1.

Comparative Example 2

Clothes were fabricated as described for Example 1, except that the bodies and sleeves were cut and sewn with the angle (A) between the axial lines of the front bodies and the fabric wales 8 of the bodies set at 0° and with the angle (B) between the sleeve cap lines 4 and the fabric wales 9 of the sleeves set at 20°, to keep the crossing angle (θ) set at 20°. The rubbing noise and friction coefficient were evaluated as described for Example 1, and the results are shown in Table 1.

Comparative Example 3

Clothes were fabricated as described for Example 1, except that the bodies and sleeves were cut and sewn with the angle (A) between the axial lines 3 of the front bodies and the fabric wales 8 of the bodies set at 15° and with the angle (B) between the sleeve cap lines and the fabric wales of the sleeves set at 150° C., to keep the crossing angle at 165° C. The rubbing noise and friction coefficient were evaluated as described for Example 1, and the results are shown in Table 1.

Comparative Example 4

Clothes were fabricated as described for Example 1, except that a 1/1 plain weave fabric having 126 warp threads per inch and 88 weft threads per inch was used. The rubbing noise and the friction coefficient were evaluated as described for Example 1, and the results are shown in Table 1.

Comparative Example 5

Clothes were fabricated as described for Comparative Example 4, except that the bodies and sleeves were cut and sewn with the angle (A) between the axial lines of the front bodies and the fabric wales 8 of the bodies set at 0° and with the angle (B) between the sleeve cap lines 4 and the fabric wales 9 of the sleeves set at 90°, to keep the crossing angle (θ) at 90°. The rubbing noise and friction coefficient were evaluated as described for Comparative Example 4, and the results are shown in Table 1.

Comparative Example 6

Conventional pants were fabricated by cutting and sewing parts with the angle between the axial lines and the fabric wales of the right front body and the right back body set at 0° and with the angle between the axial lines and the fabric wales of the left front body and the left back body set at 0°, to keep the crossing angle (θ) between the fabric wales of the rubbing course portions at 0°. The rubbing noise and friction coefficient were evaluated as described for Example 1, and the results are shown in Table 1.

The clothes of the present invention were as low as less than 50 dB in rubbing noise and friction noise, compared to those of the comparative examples.

On the other hand, the clothes of the comparative examples were more than than 50 dB or more than 60 dB in rubbing noise, and cannot be said to be excellent.

Furthermore, the clothes of the present invention were low in friction coefficient and were excellently felt to allow easy swinging with less resistance caused by rubbing of clothes at the time of golf swinging, etc.

TABLE 1

| | Weave of bodies | Weave of sleeves | Crossing angle between the axial lines and the fabric wales of bodies* (degrees) | Crossing angle between sleeve cap lines and the fabric wales of sleeves** (degrees) | Crossing angle between the axial lines of bodies and sleeve cap lines (degrees) | Linings | Friction coefficient | Sound level at 3160 Hz (dB) | Other |
|---|---|---|---|---|---|---|---|---|---|
| Example 1 | 2/1 | 2/1 | 0 | 90 | 90 | — | 0.44 | 42 | |
| Example 2 | 2/1 | 2/1 | 0 | 95 | 95 | Raised | 0.44 | 43 | |
| Example 3 | 2/1 | 2/1 | 45 | 90 | 135 | — | 0.45 | 43 | |
| Example 4 | 2/1 | 2/1 | 75 | −30 | 45 | — | 0.48 | 44 | |
| Example 5 | 2/1 | 2/1 | −15 | 135 | 120 | — | 0.52 | 45 | |
| Example 6 | 2/1 | 2/1 | 65 | 0 | 65 | — | 0.48 | 43 | |
| Example 7 | 2/1 | 2/1 | 0 | 95 | 95 | Not raised | 0.49 | 46 | |
| Example 8 | 1/1 | 2/1 | 45 | 90 | 135 | — | 0.49 | 46 | |
| Example 9 | 2/1 | 2/1 | 0 | 95 | 95 | Raised | 0.44 | 43 | |
| Example 10 | 2/1 | 2/1 | 0 | 95 | 95 | — | 0.44 | 40 | Pants |
| Comparative Example 1 | 2/1 | 2/1 | 0 | 0 | 0 | — | 1.09 | 52 | |
| Comparative Example 2 | 2/1 | 2/1 | 0 | 20 | 20 | — | 0.90 | 60 | |
| Comparative Example 3 | 2/1 | 2/1 | 15 | 150 | 165 | — | 0.83 | 60 | |
| Comparative Example 4 | 1/1 | 1/1 | 0 | 0 | 0 | — | 0.81 | 63 | |
| Comparative Example 5 | 1/1 | 1/1 | 0 | 90 | 90 | — | 0.80 | 55 | |
| Comparative Example 6 | 2/1 | 2/1 | 0 | 0 | 0 | — | 0.81 | 60 | Pants |

*: right bodies in the case of pants
**: between the axial lines and the fabric wales of the left bodies in the case of pants The clothes of the present invention have a feature in the pattern drawing angle (pattern layout angle) of bodies and sleeves, and the fabric wales of the parts are disposed to cross each other at a crossing angle of 35 to 145 degrees at the portions destined to be rubbed against each other, or the rubbing course of the mutually rubbed portions is disposed to agree in direction with the fabric wales of the parts, to ensure, in the case of top clothes, that the angle between the fabric wales of bodies and those of sleeves in case the axial lines are kept parallel to the sleeve cap lines, i.e., the angle (θ) between the axial lines and the sleeve cap lines in case the fabric wales of bodies are kept parallel to those of sleeves is set at 35 to 145 degrees, for reducing the rubbing noise and friction noise of clothes.

If the clothes of the present invention are used as raincoats for golfing and fishing, Windbreakers for running, and guards' uniforms, the rubbing noise and friction noise of the clothes can be reduced. So, the present invention provides such effects that the concentration of attention can be intensified and that the influence on the surrounding can be lessened. Furthermore, the present invention can manifest its effects also for other materials containing the portions destined to be rubbed against each other such as curtains, quilt covers, sleeping mat covers, etc., in addition to clothes.

The present invention can also provide such effects that the friction between parts can be decreased and that since the fabric is spreadable, it allows easy movement.

What is claimed is:

1. Clothes comprising a woven fabric having fabric wales, wherein said woven fabric includes a first part and a second part proximate thereto arranged so that said woven fabric wales in said first part and said fabric wales in said second part satisfy at least one of the following alternatives (i) and (ii):

(i) said woven fabric wale of said first part of said woven fabric crosses with said woven fabric wale of said second part of said woven fabric at an angle of 35 to 145 degrees when said respective parts are placed so that their axial lines are kept parallel; or (ii) said woven fabric wale of said first part of said woven fabric crosses with the axial line of said second part of said woven fabric at an angle of 55 to 125 degrees.

2. Clothes according to claim 1, wherein said one of the alternatives is the alternative (i).

3. Clothes according to claim 2, wherein said angle is 60 to 120 degrees.

4. Clothes according to claim 3, wherein said angle is 70 to 110 degrees.

5. Clothes according to claim 1, wherein said one of the alternatives is the alternative (ii).

6. Clothes according to claim 5, wherein said angle is 65 to 115 degrees.

7. Clothes according to claim 6, wherein said angle is 75 to 105 degrees.

8. Clothes according to claim 1, wherein said fabric is a woven fabric other than of plain weave.

9. Clothes according to claim 1, wherein said first part and said second part are body and sleeve, respectively.

10. Clothes, according to claim 1, wherein said first part and said second part are inner thigh portions of pants.

11. Clothes, according to claim 1, wherein said clothes include a coated or laminated fabric.

12. Clothes, according to claim 1, wherein said clothes include a lining formed by a mesh material having raised faces thereon, wherein said lining is sewn in such a manner that said raised faces contact said fabric.

13. An article of clothing, said clothing comprising a woven fabric other than of plain weave and having fabric wales, wherein said woven fabric includes a first portion and a second portion proximate thereto arranged so that said fabric wales in said first portion and said fabric wales in said second portion satisfy at least one of the following alternatives (i) and (ii):

(i) said fabric wale of said first portion of said woven fabric crosses with said fabric wale of said second portion of said woven fabric at an angle of 35 to 145 degrees when said respective portions are placed so that their axial lines are kept parallel; or (ii) said fabric wale of said first portion of said woven fabric crosses with the axial line of said second portion of said woven fabric at an angle of 55 to 125 degrees.

* * * * *